United States Patent [19]

Michelson

[11] Patent Number: 4,949,435

[45] Date of Patent: Aug. 21, 1990

[54] PAPER CLIP

[76] Inventor: Gary K. Michelson, 438 Sherman Canal, Venice, Calif. 90291

[21] Appl. No.: 257,849

[22] Filed: Oct. 14, 1988

[51] Int. Cl.[5] ..... B42F 1/02

[52] U.S. Cl. ..... 24/67.9; 24/546

[58] Field of Search ..... 24/67.9, 67 R, 67.3, 24/67 CF, 545, 546, 547, 548, 549, DIG. 8, DIG. 9, DIG. 10; D19/65

[56] References Cited

U.S. PATENT DOCUMENTS

| | | | |
|---|---|---|---|
| 184,626 | 11/1876 | Jewett | 24/546 |
| 395,473 | 1/1889 | Bartley | 24/67.9 |
| 715,992 | 12/1902 | Cox | 24/548 |
| 743,017 | 11/1903 | McGill | 24/545 |
| 795,048 | 7/1905 | Maguire | 24/67.9 |
| 1,334,233 | 3/1920 | Dinwiddie | 24/547 |
| 1,336,626 | 4/1920 | Hall | 24/547 |
| 1,783,099 | 11/1930 | Ries | 24/546 |
| 2,642,638 | 6/1953 | Larrabee | 24/67.9 |
| 2,822,593 | 2/1958 | Sponsel | 24/67.9 |
| 4,286,358 | 9/1981 | Levin | 24/67 R |
| 4,665,594 | 5/1987 | Wagner | 24/546 |

FOREIGN PATENT DOCUMENTS

| | | | |
|---|---|---|---|
| 317844 | 9/1902 | France | 24/67.9 |
| 1439151 | 4/1966 | France | 24/370 |
| 709353 | 5/1954 | United Kingdom | 24/67.9 |

OTHER PUBLICATIONS

Horders Inc. Cat. #56, 1952, One Sheet "Paper Clips and Fasteners".

*Primary Examiner*—Victor N. Sakran
*Attorney, Agent, or Firm*—Lewis Anten

[57] ABSTRACT

An improved paper clip is disclosed consisting of a single piece of wire bent so as to have a straight top spine portion, two straight side leg portions substantially perpendicular to each end of the top spine portion and bent portions extending from, each side leg portion diagonally at approximately 45 degrees in the direction of the top spine portion. Each bent end portion extends from more than ½ the diagonal distance from the end of the side leg portion to the top spine portion.

1 Claim, 2 Drawing Sheets

FIG. 2
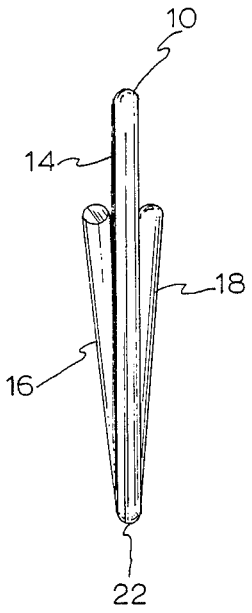
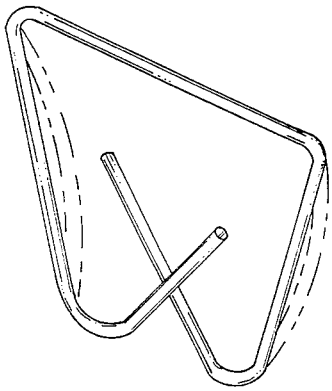
FIG. 4

PAPER CLIP

BACKGROUND

Paper clips are generally used as expendable items to either temporarily attach papers or as indexing markers.

Use of the common paper clip presents a number of problems. In use, the two loops of the common paper clip must be digitally manipulated and manually spread so that papers can then be inserted between the loops. The common paper clip does not work well for any significant thickness of paper, being difficult to apply, and once applied is physically deformed, in the process, such that it cannot be reused without being deliberately and correctionally rebent by the user. Further, when used with any significant thickness of paper, the loops of the common paper clip torque on their long axises such that the clip will not lie flat on the papers and will simultaneously protrude from the plane of the papers on either side. This also results in the sharp ends of the legs digging into the papers causing damage. More damage will usually occur during removal of the clip as the clip is dragged ever deeper into the paper.

Also, because the loops of the paper clip are being spread apart, there is a tendency for the common paper clip to try to close by forcefully ejecting off of a thick group of papers, thereby presenting a very real threat to the user, who may be struck in the eye.

Apart from their use in temporarily attaching papers, paper clips are also used as indexing markers, as when they are placed on documents to indicate an area to be read or signed, or as when used to bracket a significant chapter within a book. The common paper clip is however, poorly designed for this purpose When used within a book, the pages of the book are damaged when the book is closed over the rotated legs of the clip from both the kinking of the pages and the driving of the bare ends of the common paper clip into the page. When used to index important papers the visible end is relatively small, such that it is not always clearly visible when the book is closed. Further, the documents may be damaged upon removal of the clips.

In addition to the common paper clip, other clips have been proposed, such as disclosed in the accompanying prior art statement. Such clips suffer from one or more of the following disadvantages: They will not accommodate any significantly thickness of papers; tend to forcefully eject from a thick group of papers; do not lie flat; require finger manipulation and spreading of the legs for application; are easily deformed; or are expensive.

The Acco clamp shown in the Prior Art Statement, while appearing to have some resemblance to the present invention upon casual inspection, will be found to be heavy, bulky and without advantage, unnecessarily complex. It should be observed that the clamp is constructed such that a pair of looped legs extend from the top spine at a 60 degree angle, and in completing their long journeys cross each other four times. This produces an out of plane angular deformity such that this device cannot lie flat when applied to any significant thickness of papers because the legs deploy and rotate out of the surface plane of the papers. As a further result of the legs crossing each other no less than four times and therefore, contacting the contained papers in at least as many places, and because of the rigidity of the overall construction, damage to the papers is common with its use.

Other clips commonly referred to as "bulldog" clamps, are in actuality just that a clamp, and are for the purpose of holding together very large stacks of papers. These clamps are extremely heavy, bulky and relatively expensive as compared to the more common paper clip. Due to the above limitations, they are generally found to be of limited use and are not appropriate for use in the mail. Furthermore, they have little merit as indexing or place marker devices.

DESCRIPTION OF THE PRESENT INVENTION

The present invention utilizes a minimal length of wire and is constructed such that the side legs extend at a right angle to the top spine, and each side leg has a bent portion, such that the bent portion extends diagonally at a 45 degree angle towards the top spine. The bent portions cross one another one time and one time only. In the preferred embodiment the length of each side leg is equal to the length of the top spine.

The present invention is, despite its relative apparent simplicity, a technological advancement and is superior to the prior art in the following ways:

1. CAPACITY. The present invention will, for any given length of material used, hold a greater thickness of material.

2. REUSEABILITY. Because of the relatively long spine to leg length ratio, wherein the spine acts as a torque spring, the present invention will accommodate the greatest thickness of material within the range of elastic recovery as compared to the common paper clip with its short spine and long legs, which will undergo plastic deformation.

3. EASE OF APPLICATION. The common paper clip requires digital manipulation of the loops to spread them so that a thickness of papers may be inserted. The present invention has a funnel-like engagement means to facilitate the introduction of the papers. Furthermore, it is possible with a thick stack of papers to introduce the present invention at a right angle to the plane of the papers and then, after engaging the bent portions, to twist the paper clip planar to the papers, thereby applying the present invention to a rather extraordinary thickness of material, as compared to the common paper clip.

4. ABILITY TO LIE FLAT. The side legs and the bent portions of the paper clip of the present invention, will lie flat to the surface of the papers to which it is applied, regardless of the thickness of papers.

5. EASE OF REMOVAL. The common paper clip is wedged apart by the material held, and since the ends are angled towards the apex and therefore into the plane of the papers being held, the ends of the common paper clip tend to embed into the contents, damaging the papers when removal is attempted. The present invention may be atraumatically removed by gently pressing the bent portion of the legs int the plane of the paper whereby the bend portion behave as fulcrums, thereby lifting the cut ends of the clip out of the plane of the papers and allowing for a smooth and atraumatic removal of the paper clip of the present invention.

6. INDEXING FEATURES. The paper clip of the present invention, because of its relatively long and easily seen spine, serves as an improved indexing device:

7. SAFETY. The common paper clip has a relatively small spine which is wedged apart in its application.

This tends to, when applied to a thick group of papers, eject forcefully, imperiling the user who may be struck in the eye. In contrast, the paper clip of the present invention, with its broad spine absorbs the angular moment over a longer torque spring mechanism, and has to undergo less of an angular distortion. Furthermore, the paper clip of the present invention tends to resist dislodgement as the free ends do not reach to the spine, but deliberately end over the surface of the contained material. These free ends tend to act as brakes to resist dislodgement until the angles of the legs are deliberately depressed, thereby serving as fulcrums and lifting the free ends out of the surface plane of the papers to facilitate removal.

8. ECONOMICS. The paper clip of the present invention utilizes less material and is more simple to manufacture than the common paper clip.

9. MAILABILITY. Because the paper clip of the present invention is inexpensive, and thereby highly expendable, light in weight, has a large capacity for its small size, lies flat, and does not protrude from the papers themselves, it is ideally suited for use on documents to be mailed.

OBJECT OF THE PRESENT INVENTION

It is an object of the present invention to provide for a paper clip that is more economical.

It is another object of the present invention to provide for a paper clip which is capable of holding a larger capacity of papers.

It is another object of the present invention to provide for a paper clip which is more easily used.

It is still another object of the present invention to provide for a paper clip which is safer to use.

It is yet another object of the present invention to provide for a paper clip which will reduce damage to papers or books.

It is yet another object of the present invention to provide for a paper clip which is more effective.

It is also an object of the present invention to provide for a paper clip which is more easily visualized.

These and other objects of the present invention will be evident from a review of the specification and the accompanying drawings.

BRIEF DESCRIPTION OF THE DRAWINGS

FIG. 2 is a side view of the present invention.

FIG. 4 is an alternative embodiment of the present invention.

DETAILED DESCRIPTION OF THE DRAWINGS

Figure 1:
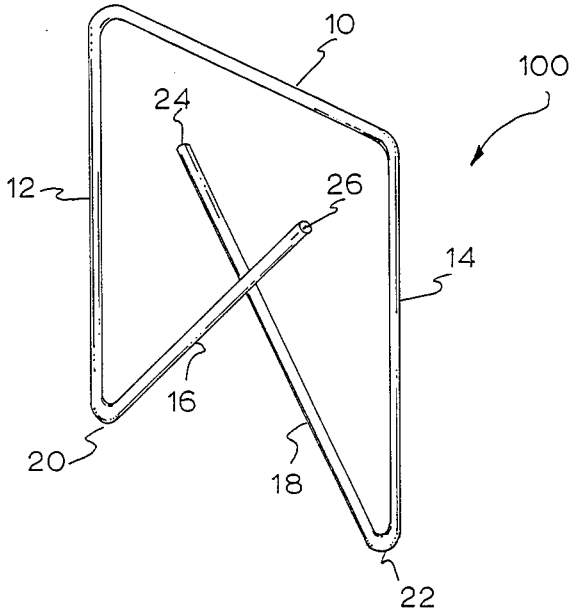
FIG. 1 is a perspective view of the paper clip of the present invention.

Referring to FIGS. 1 and 2, the preferred embodiment of the present invention is shown. A single piece of metal wire, typically used for the common paper clip, is bent so that it has a top spine 10, two side legs 12 and 14 perpendicular to the top spine 10 and two diagonally bent end portions 16 and 18. The bent end portions 16 and 18 are bent upwardly at approximately 45 degrees to the lower ends 20 and 22 of the side leg portions 12 and 14.

In the preferred embodiment, the length of the top spine 10 is approximately the same length as the side legs 12 and 14 and the length of the bent end portions 16 and 18 are approximately the same length as the side legs 12 and 14 so that the bent end portions cross each other.

The size of the paper clip may vary according to use, but the preferred size has a spine of approximately one inch, side legs one inch and bent end portions of one inch. The diameter of the wire used and the sizes may be varied according to desire.

Figure 3:
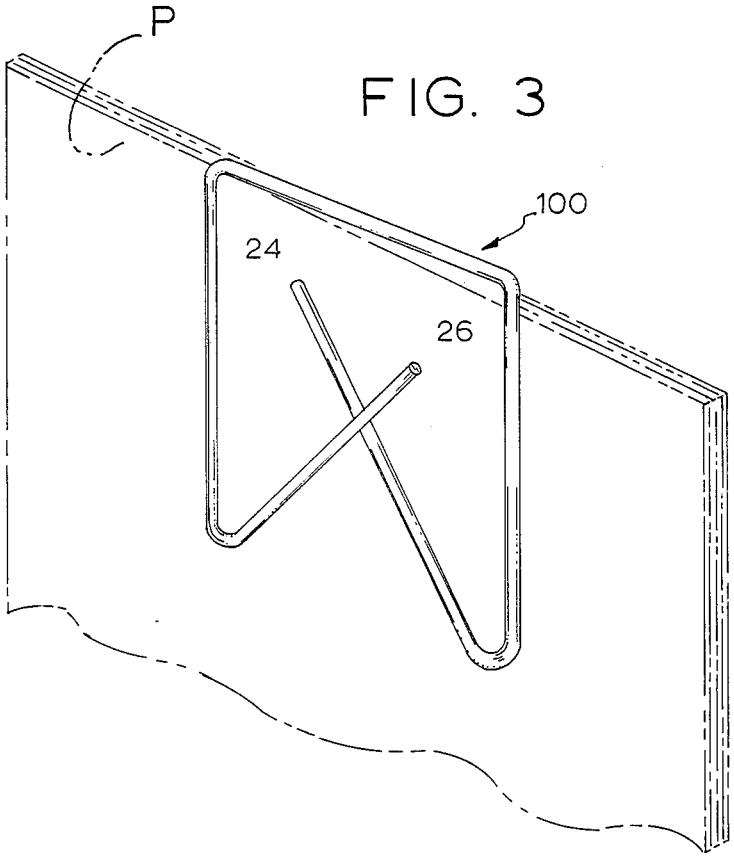
FIG. 3 is a perspective view of the paper clip of the present invention illustrated on a relatively thick pile of papers.

In FIG. 3, the paper clip 100 is shown in use on a stack of papers P, shown in dotted lines. The bent portions 16 and 18 are shown as lying flat on the stack of papers P. The free ends 24 and 26 of the bend portions 16 and 18 do not dig into the papers P.

It is recognized that variations to the present invention may be made without departing from the inventive concept disclosed. For example, referring to FIG. 4, the side leg portions may be curved outwardly or inwardly and the ends 120 and 122 are curved. Also, the angle of the side legs 12 and 14 may vary from 90 degrees, so long as the advantages obtained by the present invention are still obtained. For example, a variation of 20 degrees is acceptable.

What is claimed is:

1. A paper clip comprising a single piece of bent wire having a straight top spine portion, two side leg portions bent substantially perpendicular to the top spine portion and two bent end portions bent substantially at a 45 degree angle to the side leg portions, said end portions overlapping one another and not extending to the other side leg, said end portions having a length less than the diameter of the rectangular plane formed by said spine and said leg portions, one of said leg portions and one of said bent end portions forming a first plane and the other of said leg portions and the other of said bent end portions forming a second plane, said end portions not extending beyond the planes formed by the spine and said leg portions, and in which the length of at least one of the bent end portions is more than $\frac{1}{2}$ the distance from the end of the side leg portion to the opposite end of the top spine portion wherein said spine and said leg portions having the same length and being of sufficient length so that said spine will act as a torque spring with respect to said leg portions.

* * * * *